US007901340B2

(12) United States Patent
Alessandri et al.

(10) Patent No.: US 7,901,340 B2
(45) Date of Patent: Mar. 8, 2011

(54) EXERCISING MACHINE

(75) Inventors: Nerio Alessandri, Longiano (IT); Federico Martini, Ravenna (IT); Mario Fedriga, Forli (IT); Simone Servadei, Modigliana (IT)

(73) Assignee: Technogym S.p.A., Gambettola (IT)

( * ) Notice: Subject to any disclaimer, the term of this patent is extended or adjusted under 35 U.S.C. 154(b) by 916 days.

(21) Appl. No.: 10/915,311

(22) Filed: Aug. 10, 2004

(65) Prior Publication Data

US 2005/0070407 A1 Mar. 31, 2005

(30) Foreign Application Priority Data

Aug. 11, 2003 (IT) ..... RA2003A0024

(51) Int. Cl.
*A63B 23/00* (2006.01)

(52) U.S. Cl. ..... 482/148

(58) Field of Classification Search ..... 482/148, 482/95–96, 92, 1, 35–37, 39, 12, 23, 51, 482/135, 138, 139, 133; D21/506, 662, 67; 52/127.1, 234, 236.1, 474
See application file for complete search history.

(56) References Cited

U.S. PATENT DOCUMENTS 5,054,773 A * 10/1991 Parviainen ..... 482/98
5,056,779 A 10/1991 Webb
5,209,223 A * 5/1993 McGorry et al. ..... 601/34
5,375,641 A * 12/1994 Schlueter ..... 160/135
5,537,766 A 7/1996 Nickens
5,620,396 A * 4/1997 Westphal ..... 482/35
5,725,459 A * 3/1998 Rexach ..... 482/92
5,779,601 A * 7/1998 Ish, III ..... 482/100
5,853,332 A * 12/1998 Briggs ..... 472/128
D457,580 S * 5/2002 Webber ..... D21/675
6,443,877 B1 * 9/2002 Hoecht et al. ..... 482/103
6,447,430 B1 * 9/2002 Webb et al. ..... 482/98
6,860,836 B1 * 3/2005 Wu ..... 482/37
7,070,546 B1 * 7/2006 Grasso ..... 482/103
2002/0091043 A1 7/2002 Rexach
2003/0008756 A1 * 1/2003 Pino ..... 482/148
2003/0096684 A1 * 5/2003 Combes et al. ..... 482/121
2004/0005972 A1 * 1/2004 Sugiyama et al. ..... 482/148
2005/0011138 A1 * 1/2005 Ball et al. ..... 52/36.1
2005/0070408 A1 * 3/2005 Fallacaro ..... 482/148
2005/0144855 A1 * 7/2005 Waalkes et al. ..... 52/36.1

FOREIGN PATENT DOCUMENTS

CN 2428038 Y 5/2001
EP 0941747 A1 9/1999
EP 941747 A1 * 9/1999
WO WO02056973 A2 7/2002

* cited by examiner

*Primary Examiner*—Lori Baker
(74) *Attorney, Agent, or Firm*—Abelman, Frayne & Schwab

(57) ABSTRACT

An exercise machine (1)(101) has a work zone (20)(120) for performing physical exercise in accordance with a predetermined medical/sport program, a service zone (30)(130) adjacent to work zone (20)(120) and provided with a load group (31)(131), with the work zone (20)(120) and the service zone (30)(130) being located adjacent to each other and inscribable completely inside a minimum volume (V) of a predetermined height (H), width (L) and depth (W), and volume indicating means (40')(140') capable to render a visually discernible minimum training module (M) of predetermined dimensions which can be easily assembled and rapidly installed in a space of limited dimensions.

17 Claims, 6 Drawing Sheets

100
101
120
130
140
160
M
$V_L$

EXERCISING MACHINE

BACKGROUND OF THE INVENTION

1. Field of the Invention

The present invention relates to an exercise machine for performing anaerobic or aerobic exercises, which is designed to be installed rapidly in such a way as to ensure that a minimum amount of space is completely available for performing a training session both in an environment provided for sports training and in a home environment, even when the space available for the machine is limited. The present invention also relates to a multi-station exercise machine, comprising a plurality of training modules, each of which can be arranged with respect to the other modules depending on the requirements for management of the space within the environment in which the machine is installed.

2. Description of the Prior Art

In the field of exercise machines for performing anaerobic exercises, which are generally equipped with a counterweight load group that can be operated by an operating device connected to the load by a cable wound around a plurality of pulleys so as to define a predetermined path, it is known to isolate the load group with a grill or with some other safety screening device. The same also applies to so-called cardiovascular machines which are designed for performing aerobic exercises and where the load group, which is normally electrified, exchanges power cyclically with the user by using an operating device which in the case of running machines is an endless belt, in stepper machines and elliptical machines comprises two footboards, and in exercise bicycles comprises two pedals. In these cases the operating device is separated from the load group by a protective housing in order to prevent traumatic injury or electrocution.

Examples of anaerobic or aerobic machines with this type of protective system are widely found in any gymnasium since these protective devices have been known for a long time and the assigned herein has also manufactured them for some time. Further detailed information in connection with the above may be found at the Internet site www.technogym-.com which illustrates the machines manufactured by the assignee and in particular the counterweight machines in the product lines "Selection" and "Biostrength" for anaerobic training and the latest machine "Excite" for aerobic/cardiovascular training.

It should be noted that each of the machines in the three abovementioned product lines has, in addition to a considerable weight, also a respective work or training zone which is contained inside an ideal volume which has a predetermined form and is able to assume varying proportions depending on the physical attributes of the exercising user. This ideal volume has a form and extension which can be easily calculated on the basis of the type of movement which the user must perform in order to carry out the exercises. Obviously, this volume comprises the minimum working volume within which the user is able to access the machine freely and perform predetermined movements, such that he/she is able to experience the exercising activity in a positive manner in that it is reasonably devoid of constraints. Therefore, in the case where two machines—which may also be identical—must be arranged alongside each other, the minimum training volumes of the two machines must be kept suitably separate from each other in order to avoid interference.

The question of identifying the work zone and the corresponding service zone, such that the former can be fully used by a user during training and the latter is suitably isolated, is therefore particularly important at the time of installation and during use of the machine and, therefore, poses serious problems for the person carrying out installation. In fact, it should be commented that the space which is normally available is very limited and, therefore, it is difficult to imagine an exercise machine capable of being installing in a predetermined location within a home, or in the vicinity of another machine, being certain that the space reserved for the two zones, i.e., the work zone and service zone, has the appropriate dimensions. To this end, in order to avoid having to reorganize again at a later date each installation layout—also with some difficulty owing to the considerable amount of weight involved—the best option is to follow the manufacturers instructions who indicated the necessary conditions for correct installation and, therefore, the distance which must be maintained between predetermined points of the machine and the walls of the room or between these points and those of a machine alongside which it is to be located. Obviously it can be easily imagined that the smaller the space available, the more difficult it is to perform installation and, therefore, the greater the amount of time required and the cost of the operation. Therefore, the outcome is unfavourable both for the customer, who wastes more time and money than would be reasonable to devote to installation of an exercise machine, and for the installation engineer who, at the end of a working day, will have installed only a limited number of machines.

Accordingly, the object of the present invention is to provide an exercise machine which is devoid of the above-mentioned drawbacks and which would have a work zone or work volume of predetermined dimensions so as to ensure a minimum space completely available for performing a training session in accordance with the medical/sports program in question.

A further object of the present invention is that the machine be low-cost and allows installation of the machine rapidly by a person with little or no experience in installing gym equipment and without the need for measuring instruments.

A still further object of the present invention is to provide a machine with which it is possible to separate the work zone from the service zone with the load unit, so as to prevent unintentional interference with the latter in a simple and inexpensive manner.

Another object is to provide a machine that would allow association of electrical equipment of varying nature with the machine.

An object of the present invention is also to provide a multi-station exercise machine, equipped with a plurality of exercise machines, each of which is devoid of the abovementioned drawbacks and which for this purpose is equipped with low-cost equipment able to ensure that the machine in question can be easily installed in keeping with the respective work zone/volume, so that the latter, within each station of the multi-station machine, can be freely accessed and used by a user during training and both before and after training.

A yet further object of the present invention is that the equipment should be such that the machine can be easily incorporated in the corresponding multi-station machine, that the multi-station machine may be regarded as a set of minimum training modules which can be combined in a modular manner, that it is low-cost and that the machine itself can be easily and rapidly installed in such a manner as to ensure that the spaces occupied by the machine are sufficient for performing training sessions correctly in accordance with the medical/sports program in question.

SUMMARY OF THE INVENTION

These and other objects of the present invention, which will become apparent hereinafter are achieved by providing an exercise machine including a frame, at least one operating device which can be used by a user to perform a physical exercise, and a load group supported by the frame and connected to the operating device so that it can be operated as required by the user while training. The machine has a work zone for performing the physical exercise in accordance with a given medical/sports program and has a service zone adjacent to the work zone and in which the load group is arranged. The work zone and the service zone are inscribable completely inside a minimum volume of predetermined height, width and depth. The machine further includes volume indicating means which is capable to render a visually discernible, minimum training module which can be freely used so that it can be rapidly installed in a space of limited dimensions both individually and in combination. The volume indicating means includes a panel having dimensions roughly corresponding to the height and width of volume of the machine, so as to separate physically the work zone from the service zone to guarantee the user a minimum training work space and prevent involuntary interaction with the service zone.

The objects of the invention are further achieved by providing a multi-station exercise machine including a plurality of exercising modules, with each module being able to be freely used and equipped with at least one operating device which can be used by a user to perform a physical exercise. The machine further includes a load group supported by a frame and connected to the operating device so that it can be operated as required by the user while training using the operating device. At least one of the plurality of modules has a work zone accessible to at least one user for performing a training session and provided, for this purpose, with the operating device. The module also has a service zone adjacent to the work zone and provided with the load group. The work zone has a front section of a predetermined height and width. Each module further has means for indicating the respective volume which correspond approximately to the height and width so as to separate physically the corresponding work zone from the service zone to prevent the user engaged in training from interacting voluntarily or involuntarily with the respective associated service zone. The volume indicating means has at least one panel having dimensions which correspond approximately to the said height and width.

There is further provided, according to the invention, an equipped wall having plurality of panels which are connected together laterally by joining means able to keep exercise machines at a predetermined distance from each other, whereby a plurality of respective minimum training modules are arranged alongside each other, in order to define a predetermined training circuit.

BRIEF DESCRIPTION OF THE DRAWINGS

The description which follows will facilitate understanding of the invention, the further objects thereof, the general nature of application of invention to the field of exercise machines and the way in which it is able to solve the above-mentioned problems in a simple and low-cost manner.

The invention will now be described with reference to the accompanying drawings which illustrate some non-limiting examples of embodiments thereof and wherein.

DETAILED DESCRIPTION OF THE PREFERRED EMBODIMENTS

Figure 2:
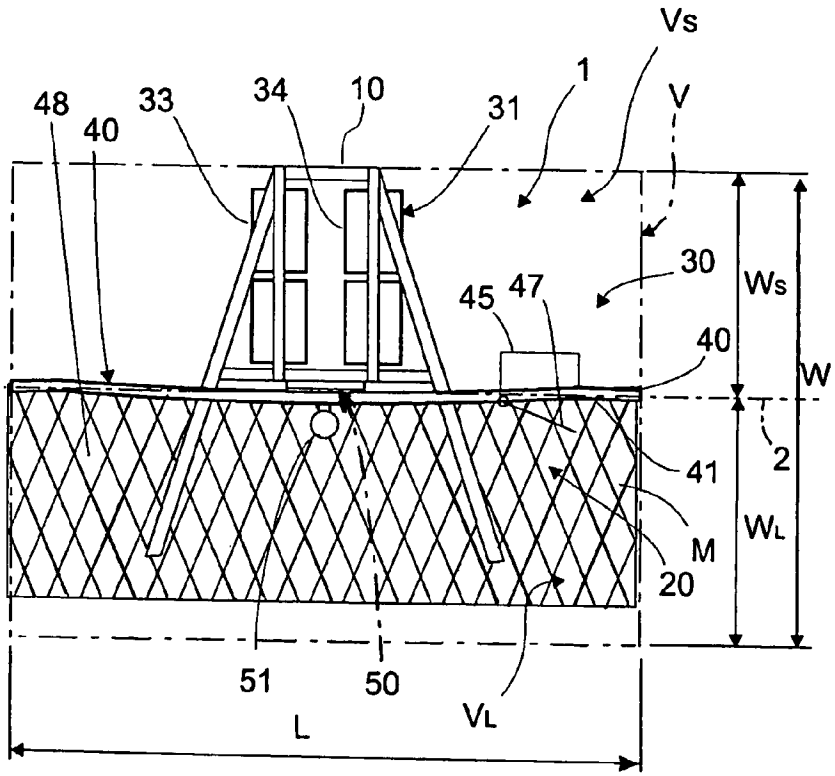
FIG. 2 is a plan view, on a smaller scale and with parts removed for the sake of clarity, of the machine shown in FIG. 1.
Figure 1:
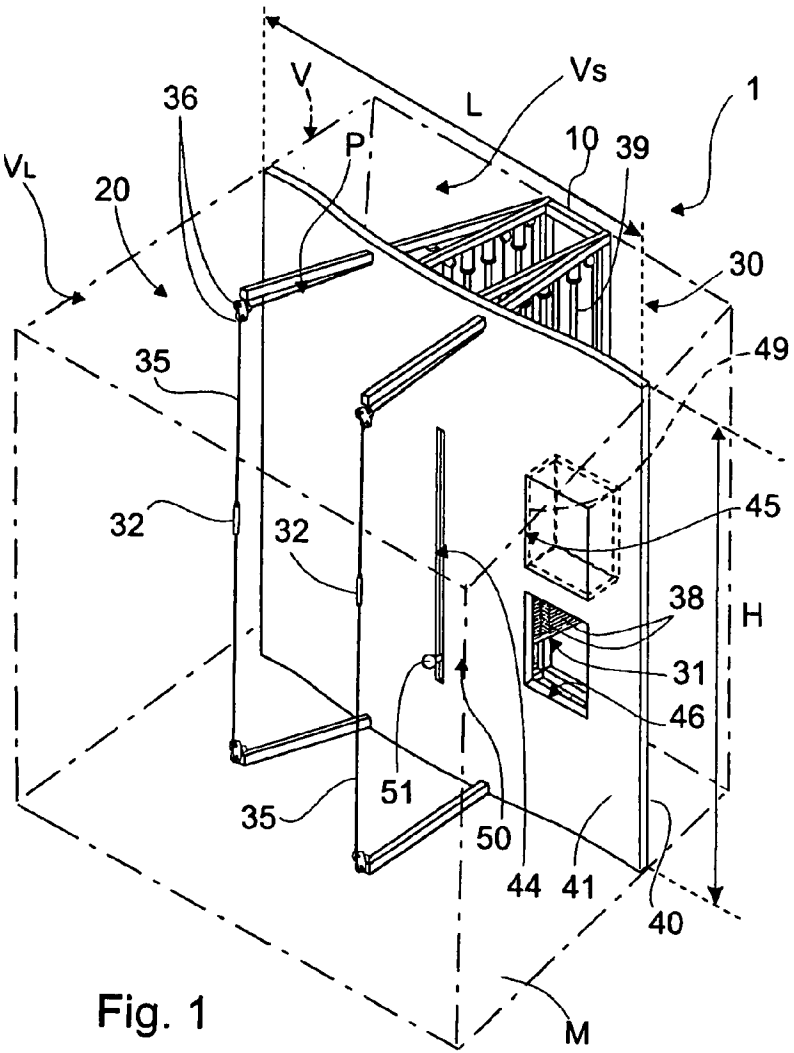
FIG. 1 is a schematic perspective view of an exercise machine according to a first preferred embodiment of the present invention.

In FIG. 1, 1 denotes in its entirety, an exercise machine which comprises a frame 10, a work station or zone 20 designed to be used by a user for performing at least one exercising activity of a predetermined type, and a service station or zone 30 situated adjacent to the work station 20 and provided with a load group 31. This load group 31, which can be seen partially in FIG. 1 and in plan view in FIG. 2, is capable to exchange exercising power with the user by using at least one interface 32, or operating device, connected to the load group 31 in a predetermined manner so as to allow an exercise to be performed. The machine 1 may be equally well of the type comprising counterweights or of any other type for aerobic exercise suitable for exercising the cardiovascular system. In any case, for the sake of convenience of illustration, the present invention is illustrated on the basis of a counterweight machine of the general type. Also in view of the fact, it will be immediately obvious that the above description is also applicable to a so-called "cardio machine", without this choice necessarily being interpreted as a precise intention to limit the type of group 31 indicated above. For the purposes of illustrative clarification, the machine 1 is of the type described in application Ser. No. 10/674,447 of the assignee herein.

With reference to FIGS. 1, 2 and 3, the load group 31 comprises at least two load units 33 and 34 which are arranged alongside each other and are separated from each other so that they may be operated separately by the interface 32 which in the case in question is a handle, which will be indicated using the same reference number. The handle 32 is associated with a cable 35 arranged between the two load units 33 and 34, to which it is connected with respective end portions which are arranged opposite to each other and act on opposite sides of the handle 32. The machine 1 also comprises a plurality of transmission devices which are in the form of drive pulleys 36 shown in FIG. 1, each of the pulleys 36 being supported by the frame 10 between the two load units 33 and 34 along a path P, being visible only partially in FIG. 1 and being engaged by the cable 35. The path P winds between the pulleys 36 and starts and terminates respectively at the load units 33 and 34. The two units 33 and 34 are both of the gravitational type and each of these comprises a plurality of blocks/counterweights 38 arranged on top of each other and supported by the frame 10 slidably along a vertical guide 39 for rectilinear movement. The operating device 32 may be formed equally well as a handle or also a belt for clasping a heel or any other constructional form of an interface which can be operated by a user.

The machine 1 is formed so that it is contained inside a prismatic volume V which in FIG. 1 has been shown, for the sake of convenience, in a parallelepiped form and has maximum overall dimensions which depend on the type of machine 1, on the dimensions of the front section of the frame 10, on the form and arrangement of the path P, on whether the machine is a single-purpose or multifunctional machine, and therefore on the type of exercise which the user is able to perform freely on the machine 1, as well as on the build and physical attributes of the user. If one considers a direction 2 which is situated between the work station 20 and the service station 30 and is shown in FIG. 2 by a horizontal dot-dash line, the volume V may be divided into at least two parts and in particular a work volume $V_L$, which is arranged at the front and encloses the station 20, and a service volume $V_S$, which is arranged at the rear and encloses the service station 30. The volume $V_L$ has a depth $W_L$, which is calculated perpendicularly with respect to the direction 2, and the volume $V_S$ has a depth $W_S$, which is also calculated perpendicularly with respect to the direction 2. The maximum cross-section of the volume V is inscribable inside a polygonal perimeter with height H and width L which can be easily determined. The machine 1 also comprises a panel 40 supported transversely by the frame 10 in order to isolate the station 30 from the station 20. The panel 40 also has dimensions which are approximately equivalent to the height H and the width L of the polygonal perimeter so as to prevent a user engaged in training from voluntarily or involuntarily interacting with the service station 30 and so as to allow definition of the volume $V_L$ of the machine 1 as a minimum training module M which can be freely used during training. The work volume $V_L$ can be easily identified by direct measurement of the height H and the width L of the panel 40 and the depth W, equal to $W_L+W_S$, which are indicated in FIG. 2. The presence of the panel 40 facilitates installation of the machine in any environment since the panel 40 acts as a guide for arranging the machine 1 alongside walls or other apparatus or, even better, allows the composition of a plurality of modules M alongside each other, each of which can be freely used for training.

This panel 40 may be formed by a single board 41 produced by rolling or extrusion of metallic or plastic material of the opaque, transparent or translucent type so that it may be permeated by any shade of light, so that the panel 40 is more homogeneous with the environment in which the machine 1 must be installed, or so as to allow the passage of light produced by light sources of any color, if necessary supported by the panel 40 as in the case of the apparatus which will be described more fully below.

Figure 3A:
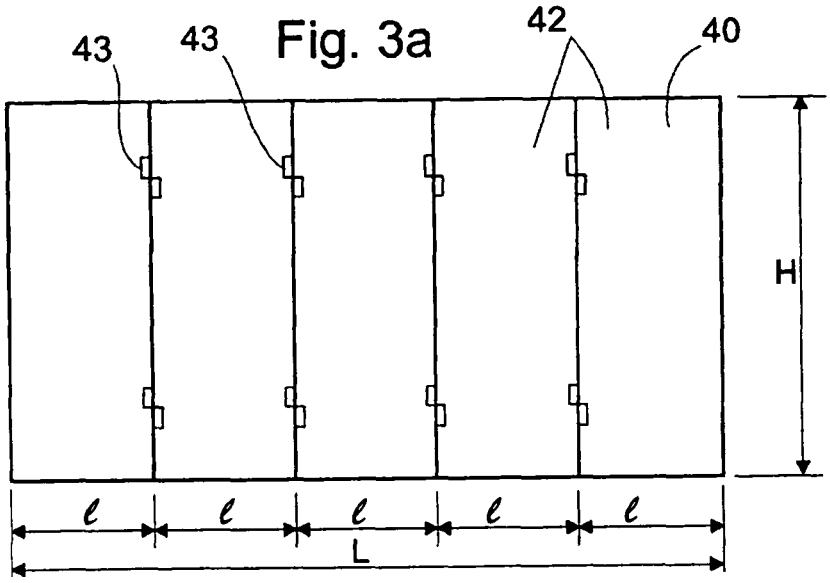
FIG. 3 shows a front elevation and plan view of some embodiments of a particular detail of FIG. 1.
Figure 3B:
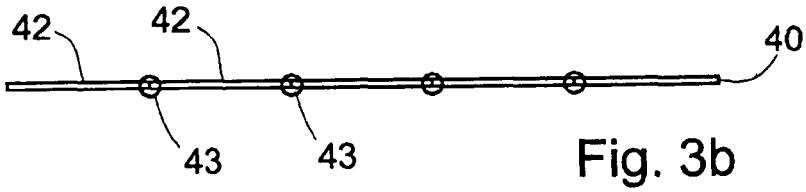
Figure 3C:
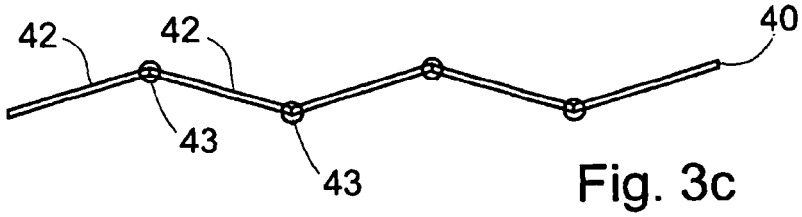
Figure 3D:
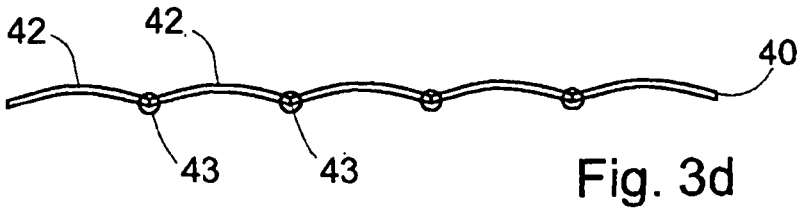
Figure 3E:
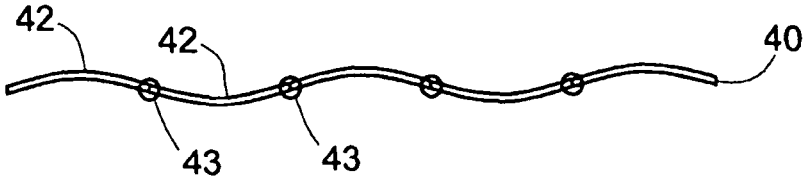

In addition, the board 4 may be curved as in FIG. 3*d* or be flat as in FIG. 3*b*. Moreover, the board 41 may be modular, thus obtained by combining transversely a plurality of elongate sheets 42, each of which may have more or less a homogeneous width 1 and extends preferably, but not exclusively, in the vertical direction in FIG. 3*a* with a height H equal to that of the panel 40. The sheets 42 are joined together in pairs by at least one interlocking or hinged connection 43 so as to define, in the first case, a surface with a precise flat or discontinuous form and, in the second case, a discontinuous surface, the sheets 42 of which may be oriented as required with respect to each other, so as to make the panel 40 easily adaptable to the machine 1 and to the environment in which the machine 1 must be installed. In the case of hinged connections 43, the sheets 42 of the panel 40 may be rotated with respect to each other so as to allow a degree of personalization of the shape of the panel 40. Still with reference to FIG. 4, at least one of the sheets 42 has a straight or curved form in plan view and sheets 42 with a straight and/or curved form in plan view may be combined together so as to obtain surface effects which may be modified if necessary over time by varying the orientation, replacement in the event of damage or the like, or the addition of sheets 42 with a different profile for various reasons. The solution of forming the panel 40 by the composition of longitudinal elements which are joined together with connecting members 43 in order to form an interlocking or a hinged system, is particularly interesting since it allows the formation of the panel 40 by combining sheets of limited width and with a longitudinal extension which may be defined as required. In addition, the sheets 42 may also be formed by rolling or extrusion of metallic or plastic material of the opaque, transparent or translucent type for the reasons described above with reference to the board 41 so that the panel 40 is permeable to light, but could also be constructed of other material, for example wood. The possibility of producing panels 40 by the assembly of sheets 42 allows the formation of panels with any longitudinal extension, minimization of the end product stocks, and an increase in the flexibility of production, favoring the optimized management of the warehouse stocks with positive effects on the financial management of the production activity. Obviously, the connecting members 43 may also be installed laterally so as to allow joining with panels 40 of other machines 1.

The machine 1 also comprises a horizontal element 48 which is visible in the sole FIG. 2 where it is shown in plan view. The element 48, which can be installed on the floor, can be formed as a footplate which defines the work volume $V_L$ at the bottom or also, more simply, as a mat having dimensions which indicate the depth of the station 20 and which therefore correspond approximately to a rectangle with sides $W_L$ and L able to provide visual information as to the plan-view extension and contours of the respective minimum training module M which can be freely used.

In connection with that described above, it can be established that the machine 1 comprises a unit 40' which is visible solely in FIG. 2 for the sake of convenience of illustration and which comprises the panel 40 and the horizontal element 48 and provides an indication as to the overall dimensions of the minimum training volume M of the machine 1.

Figure 5:
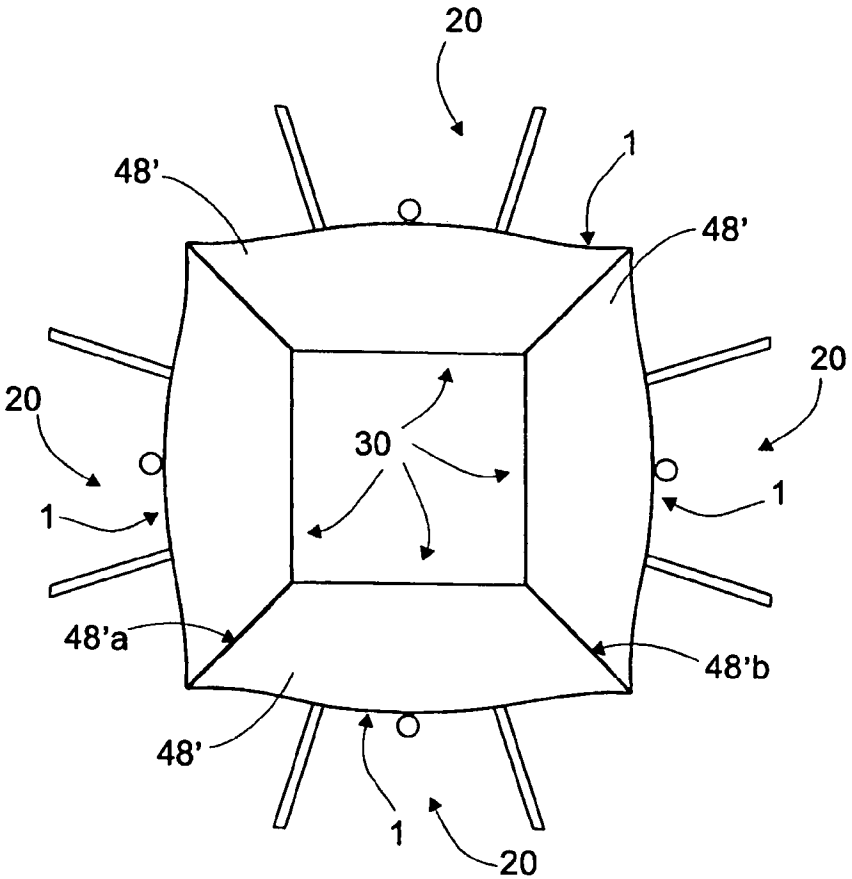
FIG. 5 is a plan view of a particular installation involving a plurality of machines of the type shown in FIG. 4.
Figure 4:
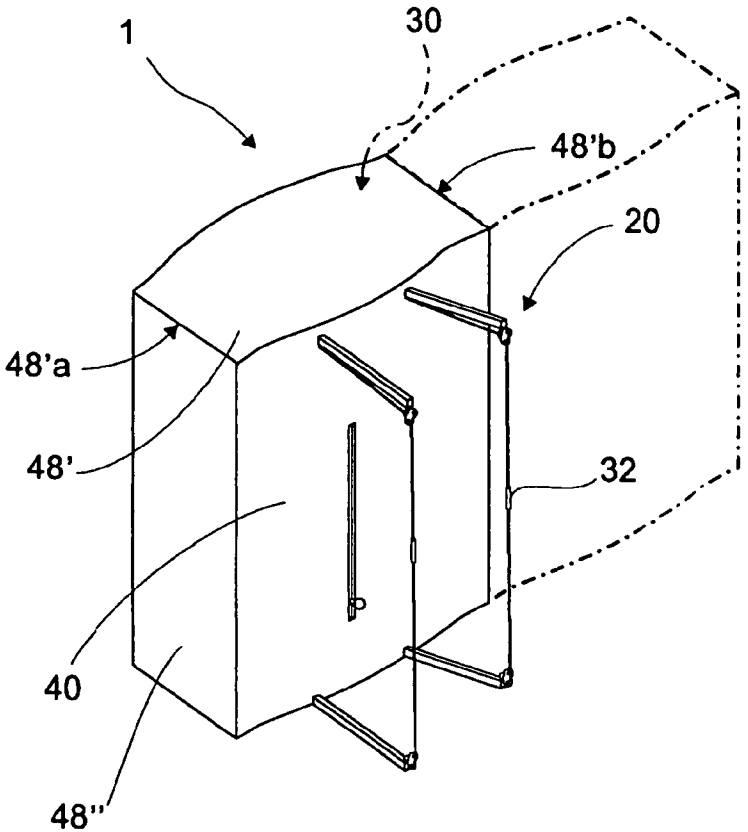
FIG. 4 is a schematic perspective view of a modified embodiment of the machine according to FIG. 1.

It should be noted that the horizontal element 48 could perform the respective function of an element indicating the volume also if it were mounted on the frame 10 in a position above the station 20 or the station 30, if necessary, supported by an upper edge of the respective panel 40. In this case, the element 48 could perform, in addition to the function of facilitating the operations of installing machines 1 alongside each other in close contact and protecting the module M, a covering function as well. Therefore, in this case the element 48 could be used to protect the machine 1 from atmospheric agents in external installations, but also prevent the deposition of dust on the operating device 32 and/or on everything which is contained within the service zone 30. Still with the same aim, the element 48 could be formed with an extension such as to cover the work zone 20 and/or the service zone 30. With reference to FIG. 4, for example, this figure shows a non-limiting embodiment of a covering 48' which is bounded by an edge which imitates at the front and rear the form of the associated panel and which is bounded laterally by two edges 48'*a* and 48'*b* which are parallel to each other and transverse to the panel 40. In this case the machine 1 has two sides 48", only one of which can be seen in FIG. 4. The two edges 48'*a* and 48'*b* are designed to constrain the manner of installation of an additional machine 1 alongside that of FIG. 4 so as to keep the two machines 1 with the respective panels 40 substantially aligned with each other. By way of example, in FIG. 4, the additional machine 1 has been shown only partially for reasons of clarity with a dot-dash line. Obviously, this lay-out has a positive effect for the modules M of the two machines 1 arranged alongside each other in that the modules M can be freely used individually without users being able to occupy them in order to perform training sessions simultaneously. This function of the cover 48' is even more obvious in FIG. 5 which shows four machines 1 with the respective covers 48' having their respective edges 48'*a* and 48'*b* inclined relative to each other substantially at right angles so that the four machines 1 may be arranged facing each other in pairs as if along the sides of a square. This angle, together with other angles of the edges 48'*a* and 48'*b* are able to indicate the correct manner of installing each machine 1 with respect to the walls or other spatial constraints, including other machines 1 with which it must be interfaced. Therefore, the edges 48'*a* and 48'*b*, allow the machines 1 to be arranged in predetermined spatial configurations which for brevity's sake need not be further explained.

Moreover, the machine 1 has a device 50 for adjusting the load, the description of which is omitted for the sake of convenience, only a knob 51 is shown. The load adjusting device 50 is described in detail in U.S. application Ser. No. 10/674,447, incorporated herein by reference thereto. This knob 51 is designed to determine the number of counterweights 38 to be raised during the course of execution of the exercise and is arranged at the interface between the work station 20 and the service station 30. The knob 51 therefore passes through the panel 40 which must have at least one slot 44 which establishes communication between the two stations 20 and 30. In particular, the slot 44 is vertical in FIG. 1.

In addition, any apparatus 49 which can be electrically powered may be associated with the panel 40. The apparatus is shown schematically in the form of a parallelepiped, only the contour of which is shown in the sole FIG. 1 in the form of a dot-dash line. This apparatus 49 could comprise at least one lamp/light source of any color, known and not shown. With particular reference to this Figure, the panel 40 may have at least one housing 40 for storing objects, which could be used to house the apparatus 49 permanently or temporarily. Obviously, the shape of the contour of this housing 45 may be of any nature, although it has been shown as having a rectangular cross-section in FIG. 1. The apparatus 49, of the known type, could comprise at least one lamp for illuminating the station 20 and/or the station 30, or for chromotherapy sessions which can be conducted, if necessary, in combination with an exercising activity, a radio, a computer, a television, a scent diffuser or any other electric household appliance. The housing 45 could also be closed by a door 47, which is visible only in FIG. 2, or contain a drawer, not shown. As an alternative or in addition to this housing 45, the panel 40 may also have an opening 46 which is bounded by a contour of any shape and left open or closed by a sheet of transparent material, known and not shown, which may also be coloured, or a mirror, for obtaining predetermined effects which may help incorporate better the machine 1 within the environmental context.

It must be noted that the housing 45 and/or the opening 46 may also be formed in at least one of the sheets of a modular panel 40, with the consequence that the panel 40 may be modified over the course of time so as to be adapted to the changing requirements of the user or in order to replace damaged portions thereof.

The use of the exercise machine can be easily understood from the description above and does not require further explanations.

From the description provided above it clearly emerges how the machine 1 can be implemented in a particularly simple and low-cost manner, fully achieving the objects mentioned above.

Finally, it is clear that modifications and variations may be made to the exercise machine 1 described and illustrated here, without departing from the scope of the present invention.

Figure 6:
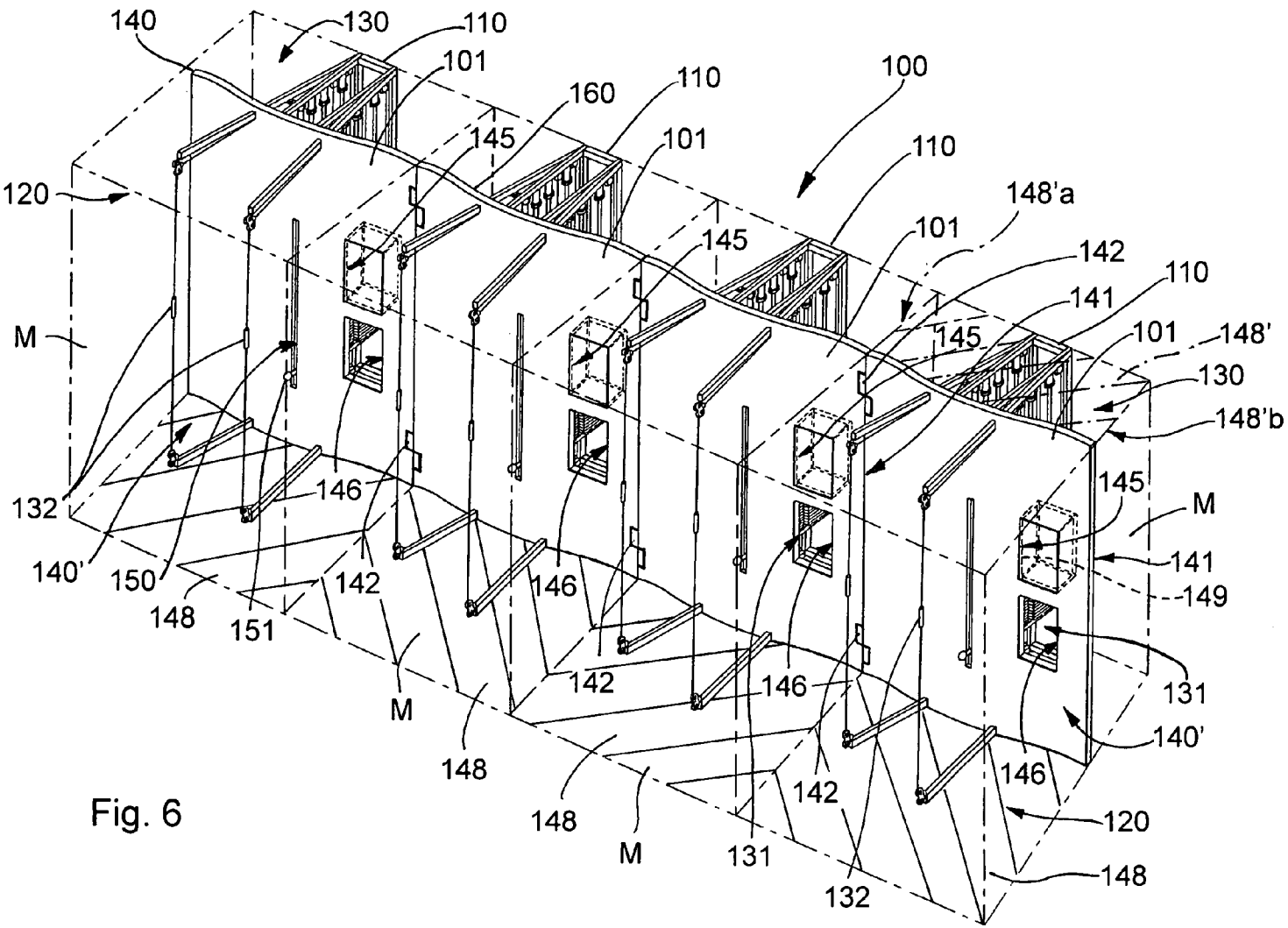
FIG. 6 is a schematic perspective view of a second embodiment of an exercise machine according to the present invention and formed of a plurality of machines according to FIG. 5, with parts removed for the sake of clarity, and arranged alongside each other.

For example, with reference to FIG. 6, it is possible to imagine converting a plurality of machines 1 so that they may be arranged alongside each other in order to obtain a multi-station machine 100. In this connection, each machine 1 must be modified with regard to the respective panel 40 which must have fastening members mounted on its respective side edges. For the sake of convenience of description of this embodiment, the machine 1 thus modified will be indicated by the number 101, the associated panel 40 will be indicated by the number 140 and the respective components which will not be explicitly numbered in a predetermined manner may be clearly identified numerically, by adding 100 to the number with which they were indicated with reference to the machine 1, if not otherwise indicated. Therefore, the machine 100 comprises a plurality of machines 101 which are arranged alongside each other and each of which is equipped with at least one operating device 132, at least one panel 140 which differs from the panel 40 by presence, along at least one of the respective side edges 141, of fastening members 142 of the interlocking or hinged type known and therefore shown only schematically by facing rectangles between the corresponding panels arranged alongside each other. The machines 1 and 101 differ from each other only in that the panels of the machine 101 are provided with members 142 and, therefore, it is particularly inexpensive and easy to perform conversion of a machine 1 into a machine 101 for a multi-station 100. Moreover, this confirms the fact already discussed, where the presence of the panel 40 means that the machine 1 may be used as a sectional module M.

Still with reference to FIG. 6, at least one of the panels 140 has at least one housing 145 which is able to house stably an apparatus which can be powered electrically and which may comprise a scent diffuser or a light source, which may be used for chromotherapy sessions, or a computer, radio or television.

It will be noted that, in connection with the above description, the multi-station machine 100 as illustrated above may also be regarded as a wall 160 which is equipped with exercise machines 101, which are all identical, or by machines 101 of varying types and arranged alongside each other so as to define a training circuit defined by the succession of physical exercise machines, or define physical barriers inside spaces assigned for training, both in order to isolate respective service stations 130 of the various machines 1 and in order to combine together the various modules M so as to form the multi-station machine 100. Each panel 140 may be individually formed in accordance with varying specifications and using the most varied combinations of housings 145 and openings 146, which combinations in FIG. 6 have been illustrated randomly on purpose.

In the case shown in FIG. 6, the panels 140 are connected together along the sides by fastening members 142 in order to keep the machines 101 at a predetermined distance from each other, while ensuring the free use of the minimum training modules M. In this case also the panels 140 may be provided with housings 145 and openings 146 which may be occupied by apparatus 149, and, in a similar manner to the panels 40, may be formed as one piece or provided with a plurality of elements which are similar to the sheets 42. Therefore, the panels 140 may be joined together in pairs so that they can be oriented as required in order to define a discontinuous or, selectively, a continuous surface. Moreover, this allows the formation of panels 140 which can be easily adapted to varying spatial requirements and can be maintained easily and at a low cost in the event of damage. Obviously, within each machine 101, each operating device 132 is associated with a load group 131 comprising counterweights or of the electrically operated type. If the load group 131 is of the gravitational type, it comprises at least one load unit 131 with counterweights and an adjusting device 150 provided with at least one user interface member 151 associated with the load unit 131.

Therefore, each module M is associated laterally with at least one other module M by fastening members which allow the machine 101 to be arranged alongside in an arrangement which takes into account the space available, while safeguarding the free use of each module M. In this way, the wall 160 is formed, in plan view, in a predetermined manner, if necessary so as to define a physical barrier inside open or closed spaces, and therefore, adapt the respective training circuits to the most varied requirements.

In a similar manner to the machine 1, each machine 101 could comprise a horizontal element 148 which is substantially identical to the element 48 in FIG. 2, to be installed on the floor so as to provide, in plan view, visual information as to the contours of the corresponding minimum training module M. In this case also the element 148 could be mounted on the frame 110 of the machine 100 or if necessary, also on a top edge of the panel 140 and hence in a position raised above the zone 120 so as to act as a cover. In this case, in a manner similar to that described above with reference to the machine 1, it is possible to combine with each module M a cover 148' which is identical to the cover 48' of the machine 1 and is bounded by edges 148'*a* and 148'*b* which allow each machine 100 to be arranged in predetermined spatial configurations which, for the sake of brevity, need not be further explained.

With respect to that described above it is possible to state that each machine 101 comprises a unit 140', shown in FIG. 4, which comprises a panel 140, the respective footplate 148, and indicates the dimensions of the minimum training volume M of the machine 101.

Figures 7A, 7B, 7C, 7D:
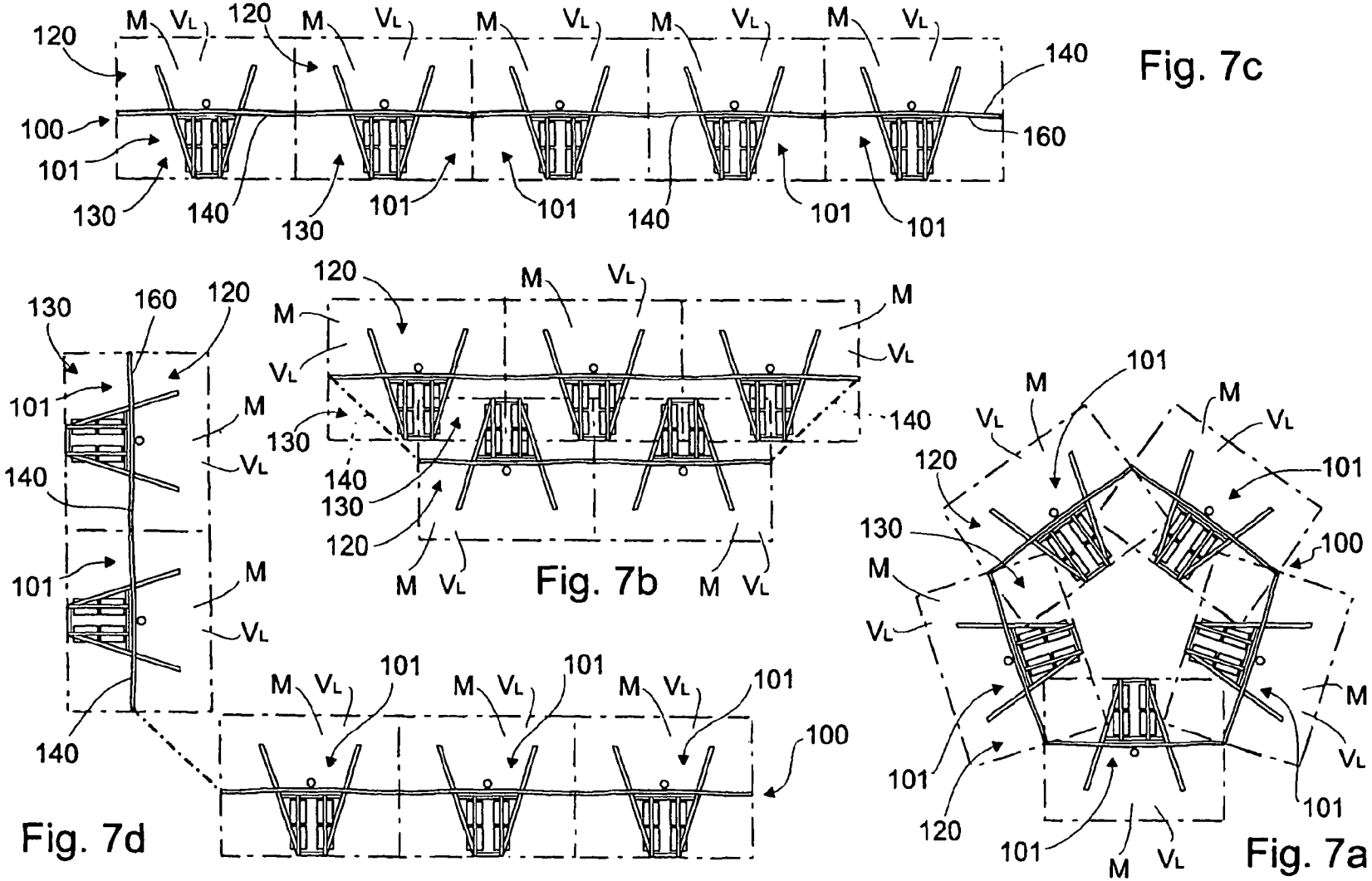
FIG. 7 shows schematically, on a smaller scale and with parts removed for the sake of clarity, a plan view of a plurality of machines of FIG. 4.

For the sake completeness, FIG. 7 shows in plan view some examples of lay-outs which may be obtained by combining modules M/machines 101 which are identical to each other or different from each other. It should be noted that individual panels 140 may be used also to close the spaces comprising a plurality of service stations 130 of machines 1/101 arranged alongside each other, in order to isolate the service stations 130 so that they are neither visible nor accessible, both when these stations 130 are separate from each other, as in the case of FIGS. 7*c* and 7*d*, and when the stations 130 are combined with each other, as shown in FIGS. 7*a* and 7*b*.

Figure 8:
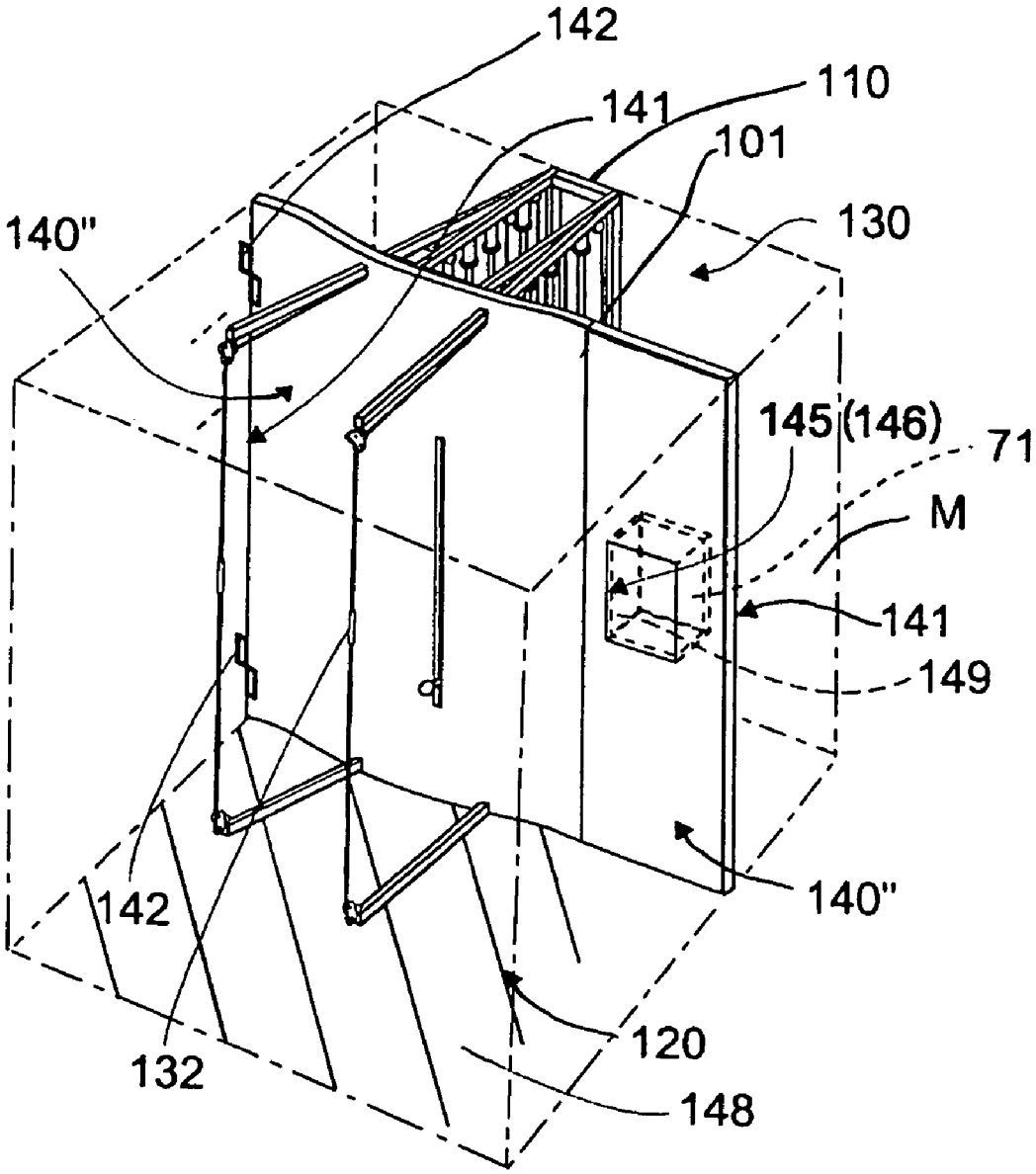
FIG. 8 shows a schematic plan view, with parts removed for the sake of clarity, of a portion of the embodiment according to FIG. 7.

With particular reference to FIG. 8, it is shown forming the panel 140 of at least one of the machines 101 by combining together at least two sheets 140" of different width. In this case, the sheet 140" of larger length could be mounted in a position facing the corresponding service zone 130, assigning implicitly to this sheet 140" the function of delimiting the corresponding module M at the front; at the same time, the sheet 140" of smaller width could be formed so as to house a computer 71 or any other device which can be powered electrically, for example, the so-called Wellness Expert manufactured by the assignee, or a similar device, inside a housing 145 or an opening 146 which is suitably formed. Obviously, the two sheets 140" corresponding to the machine 101 in question could be oriented relative to each other so as to be substantially mutually coplanar or angled depending on the requirements of the space to be furnished, without this being regarded as a constraint on the spatial arrangement of the said sheets 140".

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. An exercise machine, comprising:

a frame;

at least one operating device for performing a physical exercise and formed as a handle;

at least one load group supported by the frame and connected with the handle to be operated by a user of the exercise machine operating the handle;

an inextendable cable for connecting the at least one load group with the handle;

wherein the exercise machine has:

a work zone for performing the physical exercise and in which the at least one operating device is located;

a service zone in which the load group is located; and a panel for separating the work zone from the service zone;

wherein the work zone and the service zone occupy a minimum volume having a predetermined height, a predetermined width, and a predetermined depth;

wherein the panel visually indicates a boundary of the work zone, the panel having a height and a width substantially corresponding to the height and width of the work zone and the panel preventing interaction of a user with the service zone;

wherein the exercise machine has at least one pulley located within the work zone for supporting the cable in a freely slidable manner to allow the user to perform a wide range of physical exercises in the work zone; and wherein the exercise machine has a horizontal element having a dimension indicating a depth of the work zone and comprising a covering mounted on a top of the panel and delimited laterally by side edges which are inclined relative to each other in a predetermined manner so as to indicate a correct manner of installation.

2. An exercise machine as claimed in claim 1, further comprising:

a further arm facing the at least one arm, wherein the cable is maintained tense under action of the at least one load group to define the work zone; and wherein the at least one load group has at least two separate load units connected to respective ends of the cable and capable of producing reciprocal opposite resistance actions associated with respective movement of the handle.

3. An exercise machine as claimed in claim 1, wherein the horizontal element comprises:

a footplate shaped to provide visual information as to a plan-view extension and contours of the work zone.

4. An exercise machine as claimed in claim 1, wherein the at least one load group is electrically powered for enabling performance of a cardiovascular training exercise.

5. An exercise machine as claimed in claim 1, wherein the at least one load group is a gravitational-utilizing load group and comprises:

at least one load unit with counterweights; and an adjusting device provided with at least one user interface member associated with the at least one load group and arranged between the work zone and the service zone for isolating a predetermined number of counterweights and for defining a load of a predetermined value;

wherein the panel has at least one slot through which the at least one interface member extends.

6. An exercise machine as claimed in claim 1, further comprising:

at least one electrically powered apparatus attached to the panel.

7. An exercise machine as claimed in claim 6, wherein the panel has:

a housing for receiving the at least one electrically powered apparatus which comprises at least a computer.

8. An exercise machine as claimed in claim 1, wherein the panel is made at least partially of light-permeable material.

9. An exercise machine as claimed in claim 1, wherein the panel comprises:

at least two elongate elements which are joined together transversely to each other so that the elongate elements can be oriented as required to define, selectively, a discontinuous surface or a continuous surface, which provides for modification of an external configuration adaptable to varying requirements.

10. An exercise machine as claimed in claim 9, wherein at least one of the at least two elongate elements has a straight form in a plan view.

11. An exercise machine as claimed in claim 9, wherein at least one of the at least two elongate elements has a curved form in a plan view.

12. A multi-station exercise machine, comprising:

a plurality of exercising modules, each exercising module including:

a frame;

at least one operating device for performing a physical exercise and formed as a handle;

at least one load group supported by the frame and connected with the handle to be operated by a user of the exercising module operating the handle; and at least one pulley supported on the frame for supporting the cable in a freely slidable manner to allow the user to perform a wide range of physical exercises;

wherein each exercising module has:

a work zone accessible to the user for performing the physical exercise and in which the at least one operating device is located;

a service zone located adjacent to the work zone and in which the load group is located; and a panel for separating the work zone from the service zone;

wherein the work zone has a front section having a predetermined height and a predetermined width;

wherein the panel visually indicates a boundary of the work zone corresponding to the predetermined height and width of the work zone, whereby the panel prevents the user from interacting with the service zone; and wherein each exercising module has fastening members for laterally joining another exercising module in an arrangement defined on the basis of an available space for defining a barrier formed in a predetermined manner in at least one of a plan view and a predetermined training circuit.

13. A multi-station exercise machine as claimed in claim 12, wherein the at least one pulley is located within the work zone to enable the user to perform movements within the work zone.

14. A multi-station exercise machine as claimed in claim 13, further comprising:

a further pulley facing the at least one pulley, wherein the cable is maintained tense under action of the at least one load group to define the work zone; and wherein the at least one load group has at least two separate load units connected to respective ends of the cable and capable of producing reciprocal opposite resistance actions associated with respective movement of the handle.

15. A multi-station exercise machine as claimed in claim 12, further comprising:

a horizontal element having a dimension indicating a depth of the work zone.

16. An equipped wall which is equipped with a plurality of exercise machines, each exercise machine having a respective training module, the equipped wall comprising:

a plurality of panels; and fastening members for laterally connecting the plurality of panels with each other;

wherein the plurality of panels are associated, respectively, with the plurality of exercise machines, whereby the plurality of exercise machines are arranged at a distance from each other, with respective training modules forming a predetermined training circuit;

wherein each exercise machine has:

a work zone for performing a physical exercise and in which at least one operating device is located;

a service zone in which a load group connected to the operating device is located; and a respective one of the plurality of panels for separating the work zone from the service zone;

wherein each respective panel visually indicates a boundary of the work zone, whereby each respective panel prevents interaction of a user with the service zone.

17. An equipped wall as claimed in claim 16, wherein at least one of the plurality of exercise machines comprises:

at least one operating device for performing a physical exercise and formed as a handle;

at least one load group supported by the frame and connected with the handle to be operated by a user of the exercise machine operating the handle;

an inextendable cable for connecting the at least one load group with the handle; and at least one pulley supported on the frame for supporting the cable in a freely slidable manner to allow the user to perform a wide range of physical exercises;

wherein the exercise machine has:

a work zone for performing the physical exercise and in which the at least one operating device is located;

a service zone in which the load group is located; and a respective one of the plurality of panels for separating the work zone from the service zone;

wherein the work zone and the service zone occupy a minimum volume having a predetermined height, a predetermined width, and a predetermined depth;

wherein each respective panel has a height and a width substantially corresponding to the height and width of the work zone.

* * * * *